US009522526B1

(12) United States Patent
Aiba et al.

(10) Patent No.: US 9,522,526 B1
(45) Date of Patent: Dec. 20, 2016

(54) PRINTER PROVIDED WITH INKJET HEAD INCLUDING PARTIALLY-OVERLAPPED HEAD UNIT ROWS

(71) Applicant: Brother Kogyo Kabushiki Kaisha, Nagoya-shi, Aichi-ken (JP)

(72) Inventors: Takashi Aiba, Nagoya (JP); Shohei Koide, Nagoya (JP); Keita Sugiura, Toyoake (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/082,828

(22) Filed: Mar. 28, 2016

(30) Foreign Application Priority Data

Sep. 30, 2015 (JP) ..... 2015-192677

(51) Int. Cl.
*B41J 2/145* (2006.01)
*B41J 2/045* (2006.01)

(52) U.S. Cl.
CPC ..... *B41J 2/04505* (2013.01); *B41J 2/04586* (2013.01)

(58) Field of Classification Search
CPC ..... B41J 2/04505; B41J 2/04586; B41J 2/145; B41J 2202/19; B41J 2/15; B41J 2/155
See application file for complete search history.

(56) References Cited

U.S. PATENT DOCUMENTS 8,608,283 B1 * 12/2013 Phillips ..... B41J 2/1433 347/43
2009/0066743 A1 * 3/2009 Komatsu ..... B41J 29/393 347/14
2010/0220152 A1 9/2010 Hayashi

FOREIGN PATENT DOCUMENTS

JP 2010-201730 A 9/2010

OTHER PUBLICATIONS

Mar. 28, 2016—(US) Co-pending U.S. Appl. No. 15/082,873.

* cited by examiner

*Primary Examiner* — Thinh H Nguyen
(74) *Attorney, Agent, or Firm* — Banner & Witcoff, Ltd.

(57) ABSTRACT

In a printer, an inkjet head includes a plurality of head units. Each head unit has a nozzle layout area in which nozzles are arranged in an alignment direction crossing a conveying direction. The head units are arranged in a first row and a second row in the conveying direction. One head unit in the first row and another head unit in the second row define an overlap length. The overlap length is a length in the alignment direction of an overlap region in which the nozzle layout area of the one head unit and the nozzle layout area of the another head unit partially overlap in the conveying direction. The one head unit is shifted from the another head unit in the alignment direction. The overlap length in a center portion of the inkjet head is larger than that in each end portion of the inkjet head.

14 Claims, 11 Drawing Sheets

PRINTER PROVIDED WITH INKJET HEAD INCLUDING PARTIALLY-OVERLAPPED HEAD UNIT ROWS

CROSS REFERENCE TO RELATED APPLICATION

This application claims priority from Japanese Patent Application No. 2015-192677 filed Sep. 30, 2015. The entire content of the priority application is incorporated herein by reference. The present application is closely related to a co-pending U.S. Patent Application (corresponding to Japanese Patent Application No. 2015-192678 filed Sep. 30, 2015).

TECHNICAL FIELD

The present disclosure relates to a printer for ejecting ink droplets on a recording medium to print an image.

BACKGROUND

A conventional inkjet printer prints images by ejecting ink droplets onto a recording medium being conveyed in a prescribed direction. The conventional printer is equipped with a line-type inkjet head having a plurality of nozzles aligned in a width direction of the recording medium.

More specifically, the inkjet head has a plurality of head units (head modules) arranged in two rows that extend in the width direction of the recording medium (direction of alignment). The positions of the head units in the two unit rows are shifted from each other in the direction of alignment. Further, the layout range of nozzles in a head unit belonging to one unit row partially overlaps the layout range of nozzles in a head unit belonging to the other unit row in the conveying direction of the recording medium. Note that the head units constituting a single unit row are arranged at equal intervals in the aligned direction. Thus, any two head units of different unit rows that overlap in the conveying direction have the same amount of overlap regardless of the positions of the head units in the aligned direction.

Each head unit has a plurality of channel modules in which are formed nozzles and pressure chambers, and a plurality of actuator modules having piezoelectric elements corresponding to the pressure chambers in the channel modules. Each piezoelectric element in the actuator module has a piezoelectric layer, and two types of electrodes disposed one on either side of the piezoelectric layer. The piezoelectric element utilizes deformation generated in the piezoelectric layer (piezoelectric strain) when a prescribed drive voltage is applied across the two types of electrodes to generate a pressure wave in the corresponding pressure chamber of the channel module in order to eject ink from the corresponding nozzle.

SUMMARY

In the majority of printing jobs performed on a line printer, print text, images, and the like are printed on the widthwise center region of a recording medium, while printing on the widthwise edges of a recording medium is less common. Therefore, it stands to reason that head units in the inkjet head ejecting ink droplets toward the widthwise center region of the recording medium are used more frequently than head units ejecting ink droplets toward the widthwise edge regions on the recording medium.

It is known that the properties of the piezoelectric layers in each head unit degrade as drive voltages are repeatedly applied to the piezoelectric elements in the actuator module, leading to a gradual decline in the performance of the piezoelectric elements. Since voltage is applied more frequently across piezoelectric elements in head units that print the widthwise center region of the recording medium than in head units that print the widthwise edge regions, these piezoelectric elements will degrade more quickly. Consequently, the piezoelectric elements in head units used for the center region may degrade to the point of being unusable while piezoelectric elements in head units used for the edge regions still function sufficiently well. This is undesirable, as the service life of the overall product is shortened by the elements that degrade most rapidly.

When head units in adjacent unit rows are partially overlapped, ink ejection effected by piezoelectric elements in the overlapping region can be switched to the piezoelectric element of a head unit that is still performing well when the piezoelectric element in the other head unit has degraded. However, since the amount of overlap of head units in the conventional printer is not great in the center region requiring a higher frequency of ink ejections, such switching can only be performed among a small portion of the piezoelectric elements. Hence, such switching cannot sufficiently compensate for the degradation of piezoelectric elements.

In view of the foregoing, it is an object of the present disclosure to provide a printer that can suppress a reduction in product life caused by degradation of driving elements in the head units used with highest frequency.

In order to attain the above and other objects, the disclosure provides a printer including a conveying unit and an inkjet head. The conveying unit is configured to convey a recording medium in a conveying direction. The inkjet head is configured to eject an ink droplet on the recording medium. The inkjet head includes a plurality of head units. Each of the plurality of head units has a nozzle layout area in which a plurality of nozzles is arranged in an alignment direction crossing the conveying direction. The plurality of head units is arranged in at least two rows each extending in the alignment direction. The at least two rows include a first row and a second row that are arranged in the conveying direction. The inkjet head has end portions and a center portion between the end portions in the alignment direction. Each set of two head units of the plurality of head units includes one head unit in the first row and another head unit in the second row and defines an overlap length. The overlap length is a length in the alignment direction of an overlap region in which a part of the nozzle layout area of the one head unit and a part of the nozzle layout area of the another head unit overlap in the conveying direction. The one head unit is shifted from the another head unit in the alignment direction. The overlap length defined by a set of two head units in the center portion is larger than the overlap length defined by a set of two head units in each of the end portions.

According to another aspect, the present disclosure provides a printer including a conveying unit, a first inkjet head, and a second inkjet head. The conveying unit is configured to convey a recording medium in a conveying direction. The first inkjet head is configured to eject first ink on the recording medium. The second inkjet head is configured to eject second ink on the recording medium. The first inkjet head and the second inkjet head are arranged in the conveying direction. Each of the first inkjet head and the second inkjet head has a plurality of head units arranged in an alignment direction crossing the conveying direction. Each of the plurality of head units has a nozzle layout area in which a plurality of nozzles is arranged in the alignment direction. The plurality of head units is arranged in at least two rows each extending in the alignment direction. The at least two rows include a first row and a second row arranged in the conveying direction. Each set of two head units of the plurality of head units includes one head unit in the first row and another head unit in the second row and defines an overlap length. The overlap length is a length in the alignment direction of an overlap region in which a part of the nozzle layout area of the one head unit and a part of the nozzle layout area of the another head unit overlap in the conveying direction. The one head unit is shifted from the another head unit in the alignment direction. The overlap length defined by a set of two head units disposed in the first inkjet head is larger than the overlap length defined by a set of two head units disposed in the second inkjet head.

BRIEF DESCRIPTION OF THE DRAWINGS

The particular features and advantages of the disclosure as well as other objects will become apparent from the following description taken in connection with the accompanying drawings, in which.

DETAILED DESCRIPTION

First Embodiment

Next, an inkjet printer according to a first embodiment will be described. The inkjet printer is configured to print images by ejecting ink droplets from nozzles onto recording paper.

Figure 1:
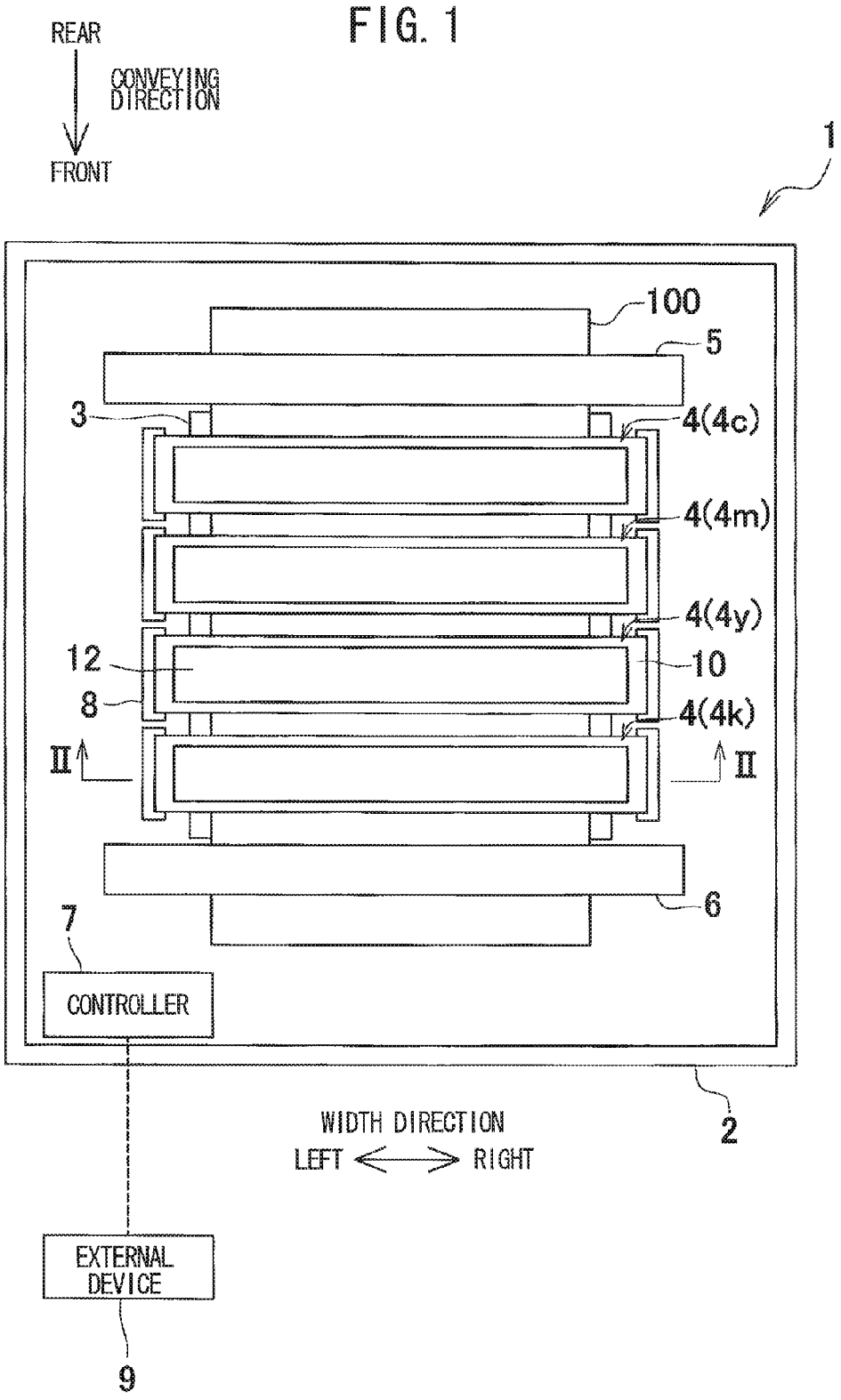
FIG. 1 is a plan view of a printer according to a first embodiment.

FIG. 1 shows a printer 1 and a sheet 100 conveyed in the printer 1. The downstream side of the sheet 100 in the conveying direction will be defined as the side nearest the front of the printer 1, while the upstream side will be defined as the side nearest the rear of the printer 1. The width direction of the sheet 100 orthogonal to the conveying direction and parallel to the plane through which the sheet 100 is conveyed (a plane parallel to the paper surface of FIG. 1) will be defined as the left-right direction of the printer 1. Here, the left side of FIG. 1 corresponds to the left side of the printer 1, and the right side of FIG. 1 corresponds to the right side of the printer 1. The vertical (up-down) direction of the printer 1 is defined as the direction orthogonal to the plane through which the sheet 100 is conveyed (the direction orthogonal to the paper surface of FIG. 1). Further, the near side in FIG. 1 corresponds to the top of the printer 1, while the far side corresponds to the bottom. The following description will use directional terms such as front, rear, left, right, up, and down as is appropriate.

Overall Structure of Printer

Figure 2:
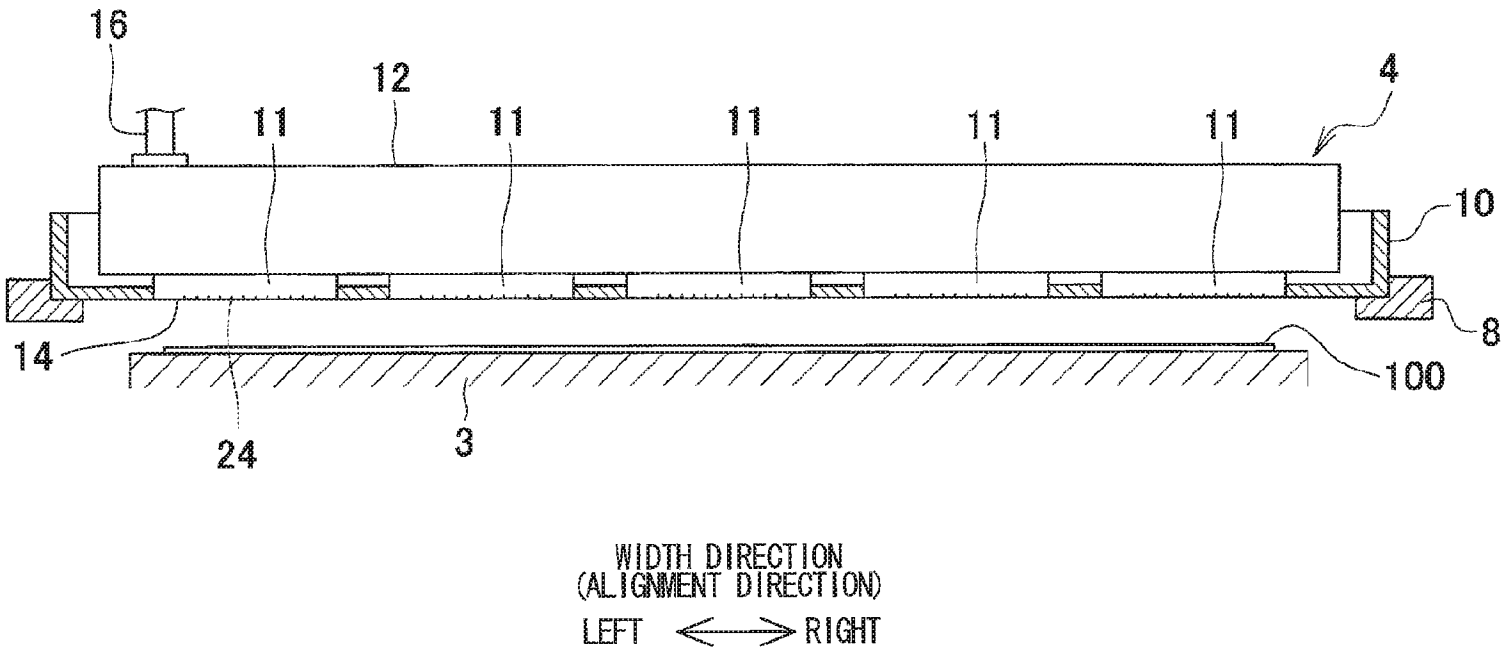
FIG. 2 is a cross-sectional view along a line II-II shown in FIG. 1.

As shown in FIGS. 1 and 2, the printer 1 includes an enclosure 2 that accommodates a platen 3, four inkjet heads 4, two conveying rollers 5 and 6, and a controller 7.

When conveyed through the printer 1, the sheet 100 is supported on the top surface of the platen 3. The four inkjet heads 4 (4*c*, 4*m*, 4*y*, and 4*k*) are arranged in order in the conveying direction above the platen 3. The conveying roller 5 is disposed on the rear side of the platen 3 (upstream side in the conveying direction), while the conveying roller 6 is disposed on the front side of the platen 3 (downstream side). A motor (not shown) is provided for driving the conveying rollers 5 and 6 to rotate in order to convey the sheet 100 forward over the platen 3.

The controller 7 includes a central processing unit (CPU), a read-only memory (ROM), a random access memory (RAM), a nonvolatile memory such as electrically erasable programmable read-only memory (EEPROM), and an application-specific integrated circuit (ASIC) that includes various control circuits. The controller 7 is also connected to a personal computer or other external device 9 and is capable of performing data communications with the same. The controller 7 is configured to control the components of the printer 1 on the basis of print data transmitted from the external device 9.

More specifically, the controller 7 is configured to control the motor that drives the conveying rollers 5 and 6 so that the conveying rollers 5 and 6 convey the sheet 100 in the conveying direction, and is configured to control the inkjet heads 4 to eject ink on the sheet 100 as the sheet 100 is conveyed. Through this operation, the printer 1 prints an image on the sheet 100.

Structure of Inkjet Heads

Next, the structure of the inkjet heads 4 will be described in greater detail. As shown in FIGS. 1 and 2, four head-retaining units 8 are mounted in the enclosure 2. The head-retaining units 8 are juxtaposed in the front-rear direction and are positioned above the platen 3 and between the conveying rollers 5 and 6. The four inkjet heads 4 are respectively retained in the four head-retaining units 8.

The inkjet heads 4 (4*c*, 4*m*, 4*y*, and 4*k*) serve to eject ink in their respective colors cyan (C), magenta (M), yellow (Y), and black (K). Ink tanks (not shown) are provided to supply ink in the corresponding colors to the four inkjet heads 4.

Figure 3:
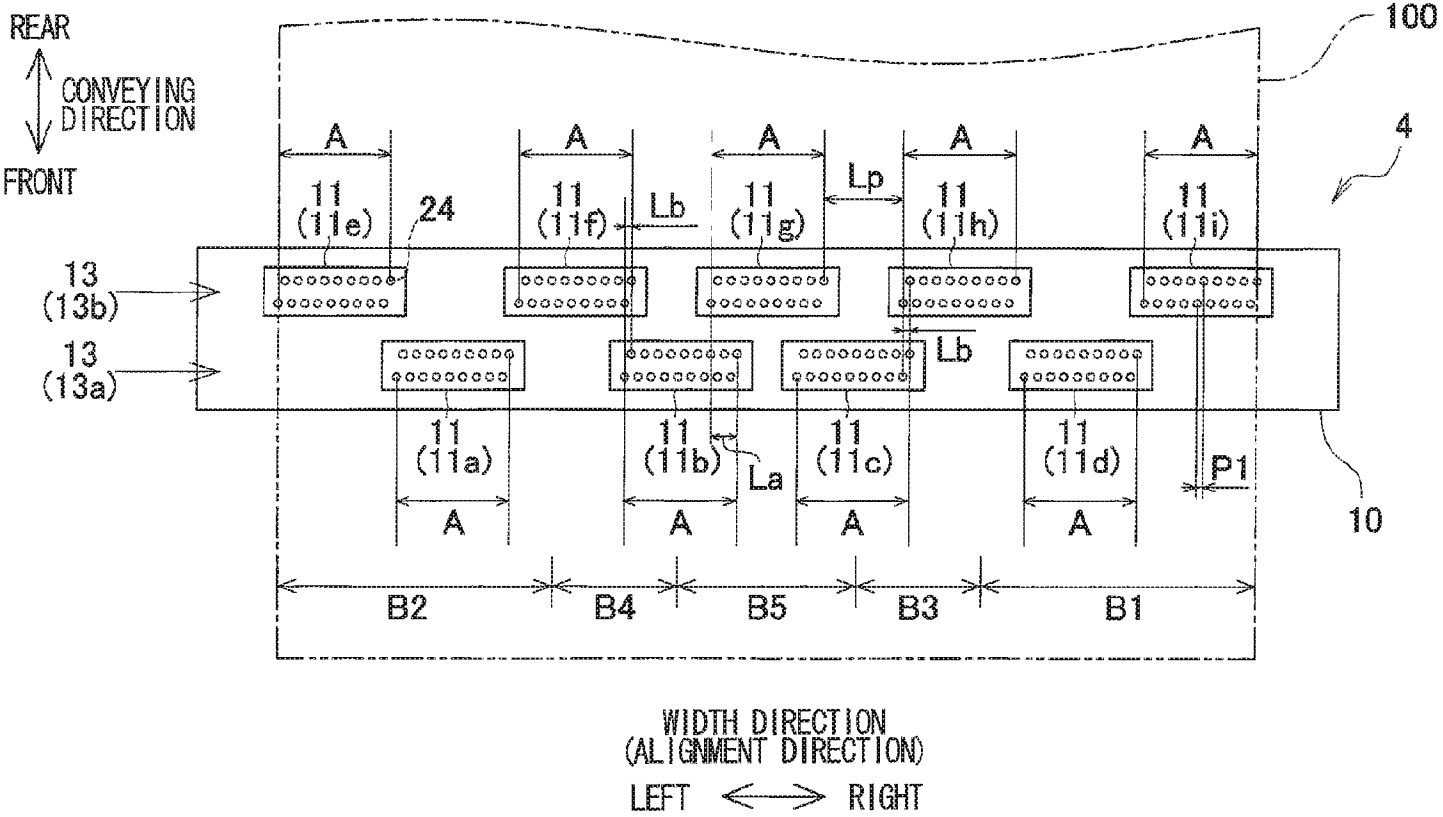
FIG. 3 is a plan view of an inkjet head of the printer according to the first embodiment.

The inkjet heads 4 all have the same structure. As shown in FIGS. 2 and 3, each inkjet head 4 includes a holder 10 having a rectangular plate shape elongated in the width direction of the sheet 100, and a plurality (nine in the first embodiment) of head units 11 mounted in the holder 10.

The bottom surface of each head unit 11 constitutes an ink ejection surface 14. Ejection holes for a plurality of nozzles 24 are formed in each ink ejection surface 14. The nozzles 24 in each head unit 11 are arranged in two rows, with the nozzles 24 in each row being aligned along the longitudinal dimension of the inkjet head 4 corresponding to the width direction of the sheet 100 (hereinafter called the "direction of nozzle alignment" or "nozzle alignment direction"). The head units 11 will be described later in greater detail.

The nine head units 11 are juxtaposed in the nozzle alignment direction and are alternately staggered to the front side and rear side relative to the conveying direction so that four of the head units 11 are positioned closer to the front side and five closer to the rear side. The left-right positions of the four head units 11 on the front side (positions of the head units 11 relative to the nozzle alignment direction) are offset from the left-right positions of the five head units 11 on the rear side. That is, the nine head units 11 are arranged in a staggered formation in the nozzle alignment direction and configure two unit rows 13 that will be called a front unit row 13*a* and a rear unit row 13*b*. The front unit row 13*a* includes four head units 11*a*-11*d*, while the rear unit row 13*b* includes five head units 11*e*-11*i*. In the first embodiment, the head units 11 are aligned in a direction that is orthogonal to the conveying direction and that corresponds to the width dimension of the sheet 100, but the head units 11 may be aligned in a direction intersecting or crossing the conveying direction by an angle of 90 degrees or greater, i.e., along a slope to the conveying direction.

Each head unit 11 has a nozzle layout area A denoting the range of nozzles in the head unit 11 in the nozzle alignment direction. The head units 11 are arranged in the unit rows 13 such that the nozzle layout area A of a head unit 11 in the front unit row 13*a* partially overlaps the nozzle layout area A of a head unit 11 in the rear unit row 13*b* with respect to the conveying direction. In other words, a part of the nozzle layout area A of the head unit 11 in the front unit row 13*a* and a part of the nozzle layout area A of the head unit 11 in the rear unit row 13*b* overlap in the conveying direction. More specifically, the two head units 11*b* and 11*c* arranged in the center region of the front unit row 13*a* with respect to the nozzle alignment direction have nozzle layout areas A that partially overlap the nozzle layout areas A in the three head units 11*f*, 11*g*, and 11*h* arranged in the center region of the rear unit row 13*b* with respect to the nozzle alignment direction.

Note that it is not essential in the present disclosure for nozzle layout areas A in the two unit rows 13 to overlap over the entire scanning range of the inkjet head 4, provided that nozzle layout areas A in the two head units 11 belonging to different unit rows 13 overlap within at least part of the scanning range of the inkjet head 4. In the first embodiment, the nozzle layout areas A of head units 11 in the two unit rows 13 do not overlap at the end portions in the nozzle alignment direction.

Further, the positions of head units 11 in the overlapping region described above are set such that the positions in the nozzle alignment direction of nozzles 24 in the head unit 11 on the front side match the positions of nozzles 24 in the head unit 11 on the rear side. In other words, a nozzle-row gap Lp between the nozzles of two neighboring head units 11 in one unit row 13 is an integer multiple of a nozzle pitch P1 of nozzles in the head units 11. For example, the nozzle-row gap Lp between the head units 11*g* and 11*h* is a distance between a most-upstream nozzle of the head unit 11*g* and a most-downstream nozzle of the head unit 11*h* as shown in FIG. 3.

Further, the overlap length of nozzle layout areas A in two head units 11 positioned in different unit rows 13 differs according to their positions in the nozzle alignment direction. In the following description, the overlap length of nozzle layout areas A for a pair of overlapped front-side and rear-side head units 11 will be called the "overlap length of head units 11" or simply the "overlap length." Further, for convenience of description, the right-end portion of the inkjet head 4 will be called a first portion B1; the left-end portion will be called a second portion B2; the portion adjacent to the left side of the first portion B1 a third portion B3; the portion adjacent to the right side of the second portion B2 a fourth portion B4; and the center portion interposed between the third portion B3 and fourth portion B4 a fifth portion B5. In other words, the five portions of the inkjet head 4 described above are arranged from left to right in the order second portion B2→fourth portion B4→fifth portion B5→third portion B3→first portion B1.

In the fifth portion B5 constituting the center portion of the inkjet head 4 in the nozzle alignment direction, the head units 11*b* and 11*c* on the front side each overlaps the head unit 11*g* on the rear side with the same overlap length La. The head unit 11*b* and head unit 11*f* overlap in the fourth portion B4 positioned to the left of the fifth portion B5, and head unit 11*c* and head unit 11*h* overlap in the third portion B3 positioned to the right of the fifth portion B5. The overlap length of head units 11 in both the fourth portion B4 and third portion B3 is an overlap length Lb, which is smaller than the overlap length La in the fifth portion B5. As described earlier, nozzle layout areas A do not overlap between front-side and rear-side head units 11 in the second portion B2 and first portion B1 positioned on the ends of the inkjet head 4 relative to the nozzle alignment direction.

Hence, the overlap length of head units 11 grows smaller toward the ends in the nozzle alignment direction. That is, overlap length La in B5>overlap length Lb in B3 and B4>overlap length in B1 and B2. The reason for setting different overlap lengths of head units 11 based on their positions in the nozzle alignment direction will be described later.

As shown in FIGS. 1 and 2, each inkjet head 4 has a reservoir 12 arranged above the nine head units 11. Note that the reservoir 12 has been omitted from the drawing of FIG. 3. The reservoir 12 is connected to an ink tank (not shown) by a tube 16. The reservoir 12 temporarily stores ink supplied from the ink tank. The bottom portion of the reservoir 12 is connected to each of the nine head units 11 and supplies ink thereto.

Detailed Description of Head Units

Figure 4:
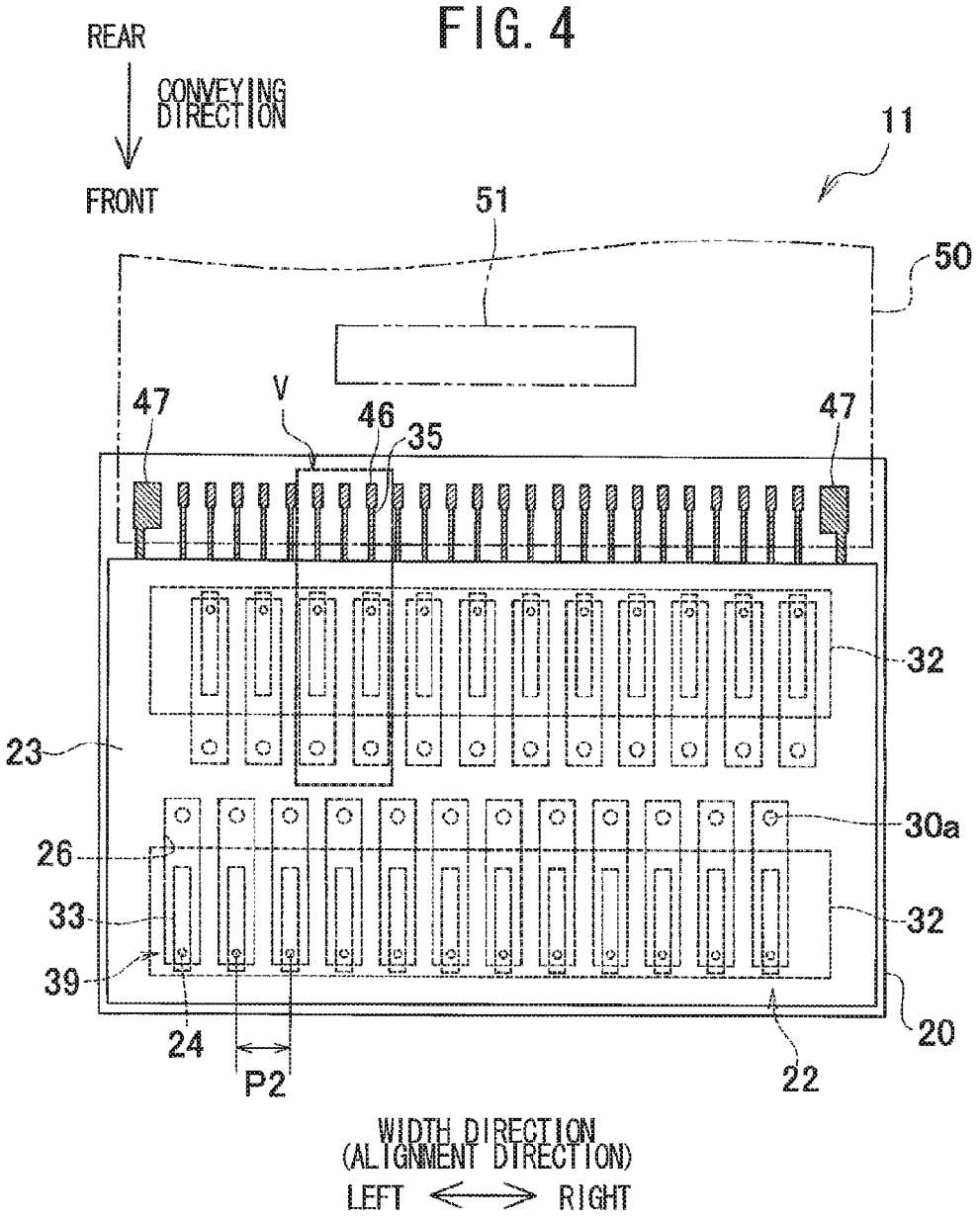
FIG. 4 is a plan view of a head unit included in the inkjet head shown in FIG. 3.
Figure 5:
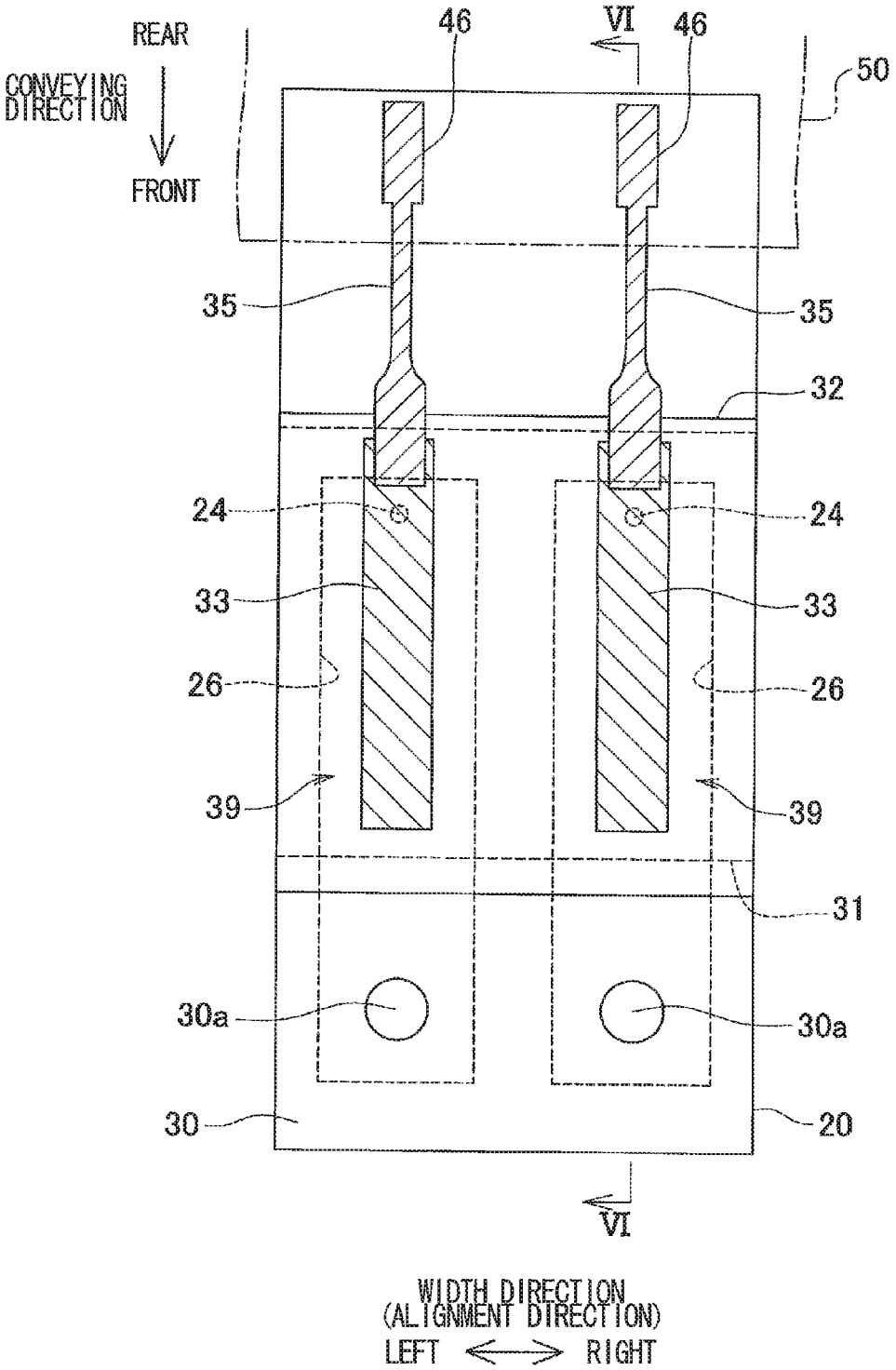
FIG. 5 is an enlarged view of a portion V shown in FIG. 4.
Figure 6:
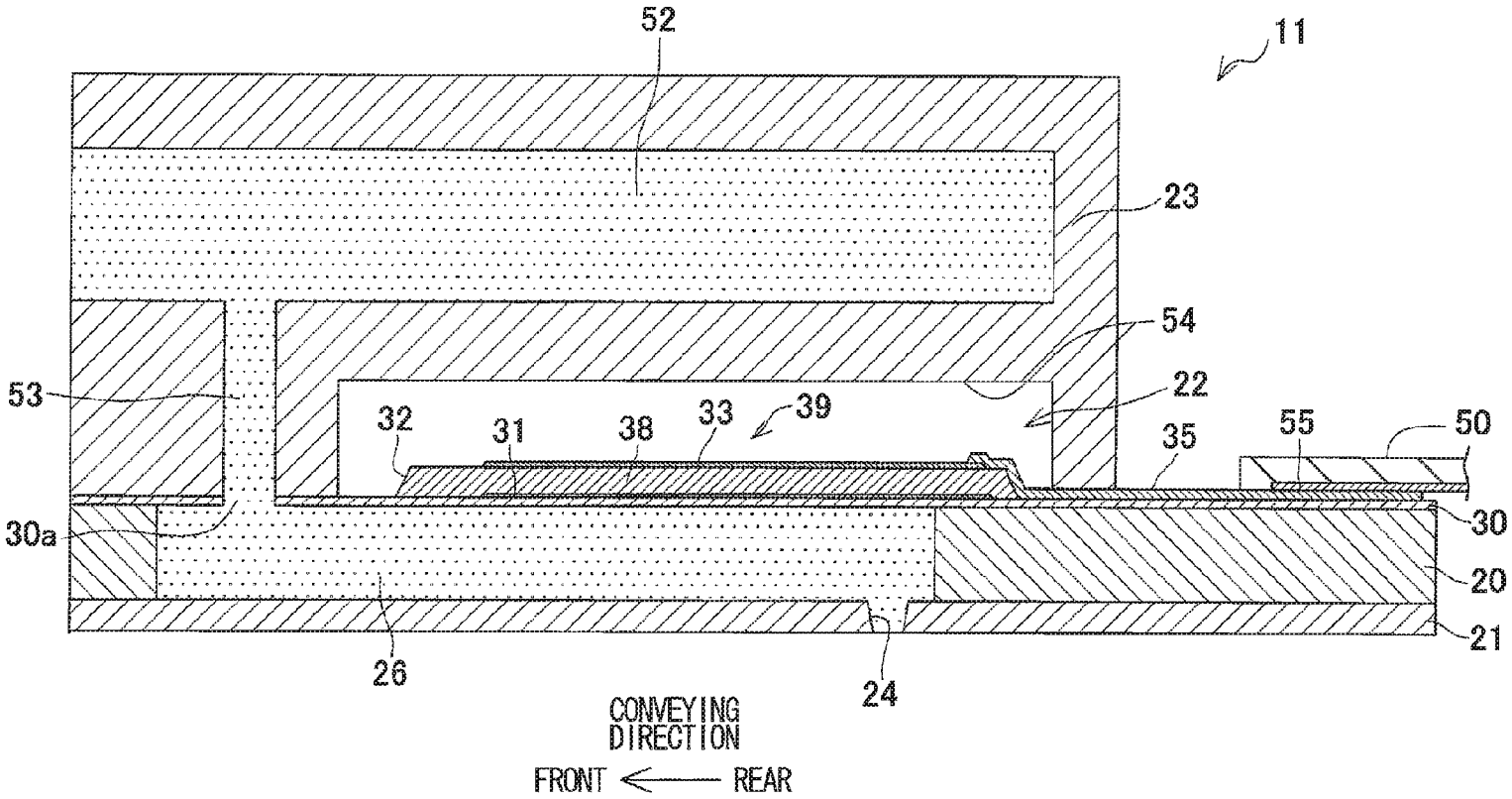
FIG. 6 is a cross-sectional view along a line VI-VI shown in FIG. 5.

Next, the head units 11 will be described in greater detail. As shown in FIGS. 4-6, each head unit 11 includes a channel substrate 20, a nozzle plate 21, a piezoelectric actuator 22, a cover member 23, and an interconnection member configured of a chip-on-film (COF) 50. Note that the cover member 23 positioned above the piezoelectric actuator 22 has been omitted from FIG. 5 to facilitate understanding of the structure of the piezoelectric actuator 22.

Channel Substrate

The channel substrate 20 is a monocrystalline silicon substrate. A plurality of pressure chambers 26 is formed in the channel substrate 20. The pressure chambers 26 have a rectangular shape with the long side extending in the conveying direction. As shown in FIG. 4, the pressure chambers 26 are juxtaposed in the aligned direction corresponding to the width direction of the sheet 100 and are configured of two pressure chamber rows juxtaposed in the conveying direction. A diaphragm 30 is formed on the channel substrate 20 for covering the plurality of pressure chambers 26. The diaphragm 30 is a membrane that includes silicon dioxide ($SiO_2$) or silicon nitride ($SiN_x$) formed by partially oxidizing or nitriding the surface of the silicon channel substrate 20. Through-holes 30*a* are formed in the diaphragm 30 at positions overlapping inner ends of the corresponding pressure chambers 26.

Nozzle Plate

The nozzle plate 21 is bonded to the bottom surface of the channel substrate 20. A plurality of the nozzles 24 is formed in the nozzle plate 21. The nozzles 24 respectively communicate with the plurality of pressure chambers 26 formed in the channel substrate 20. As shown in FIG. 4, the nozzles 24 are arranged to overlap the outer ends of the corresponding pressure chambers 26. In other words, the nozzles 24 are arranged in the nozzle alignment direction corresponding to the width dimension of the sheet 100 at positions corresponding to the pressure chambers 26 and constitute the two nozzle rows that are juxtaposed in the conveying direction. The positions of the nozzles 24 in different nozzle rows are offset from each other in the nozzle alignment direction by half the alignment pitch P2 of nozzles in a single nozzle row. In other words, the nozzle pitch P1 in each head unit 11 shown in FIG. 3 is half the alignment pitch P2 shown in FIG. 4 of nozzles in each nozzle row. While there is no particular restriction on the material of the nozzle plate 21, the nozzle plate 21 may be a monocrystalline silicon substrate like the channel substrate 20. Alternatively, the nozzle plate 21 may be formed of a synthetic resin material.

Piezoelectric Actuator

The piezoelectric actuator 22 applies ejecting energy to ink in the plurality of pressure chambers 26 in order to eject ink droplets from the corresponding nozzles 24. As shown in FIGS. 4 through 6, each piezoelectric actuator 22 is provided with a plurality of piezoelectric elements 39 arranged on the top surface of the diaphragm 30 at positions corresponding to the pressure chambers 26.

Here, the structure of the piezoelectric elements 39 will be described. In the first embodiment, the piezoelectric elements 39 are formed on the top surface of the diaphragm 30 through sequential deposition of a plurality of thin films, including a film constituting a lower electrode 31, films constituting piezoelectric layers 32, and films constituting upper electrodes 33.

The lower electrode 31 is formed over the top surface of the diaphragm 30, extending across the plurality of pressure chambers 26 in the nozzle alignment direction. The lower electrode 31 is a common electrode for the plurality of piezoelectric elements 39. While there is no particular restriction on the material of the lower electrode 31, the lower electrode 31 may be formed of platinum (Pt), for example.

Two piezoelectric layers 32 corresponding to the two rows of pressure chambers 26 are arranged on top of the lower electrode 31. Each piezoelectric layer 32 has a rectangular planar shape that is elongated in the nozzle alignment direction and is arranged to span across the plurality of pressure chambers 26 constituting the corresponding single pressure chamber row. For example, the piezoelectric layer 32 is configured of a piezoelectric material whose primary component is lead zirconate titanate (PZT), which consists of mixed crystals of lead zirconate and lead titanate.

A plurality of the upper electrodes 33 corresponding to the pressure chambers 26 is formed on the top surfaces of the piezoelectric layers 32. The upper electrodes 33 are formed of platinum (Pt) or iridium (Ir), for example. In the first embodiment, individual upper electrodes 33 are provided for each pressure chamber 26, while a common lower electrode 31 is provided for the plurality of pressure chambers 26, but the upper electrode may be shared while the lower electrodes are provided individually instead.

With the above configuration of the first embodiment, a single piezoelectric element 39 is configured of a single upper electrode 33, the portion of the common lower electrode 31 corresponding to a single pressure chamber 26, and the portion of a piezoelectric layer 32 corresponding to the single pressure chamber 26. Hereinafter, the portion of the piezoelectric layer 32 that is interposed between the upper electrode 33 and the lower electrode 31 of a piezoelectric element 39 will be called the active region 38 of the piezoelectric element 39.

An interconnect 35 is connected to the upper electrode 33 of each piezoelectric element 39. The interconnects 35 are formed of aluminum (Al) or gold (Au), for example. Each interconnect 35 extends upstream in the conveying direction (rearward) from the upper electrode 33 of the corresponding piezoelectric element 39. A plurality of drive contact parts 46 respectively connected to corresponding interconnects 35 and two ground contact parts 47 connected to the lower electrode 31 are arranged on the top surface of the channel substrate 20 on the exposed rear edge thereof, i.e., on the edge of the channel substrate 20 that is not covered by the cover member 23 described later. In the first embodiment, the drive contact parts 46 and ground contact parts 47 are arranged outside of both rows of pressure chambers 26, but the contact parts may instead be arranged between the two rows of pressure chambers 26, with the interconnects 35 running inward from the upper electrodes 33 in the conveying direction.

The COF 50 constituting an interconnection member is bonded to the top surface of the channel substrate 20 on the rear edge thereof. A plurality of interconnects 55 is formed on the COF 50. The drive contact parts 46 on the channel substrate 20 side are electrically connected to corresponding interconnects 55. Ground interconnects (not shown) are also formed on the COF 50. The two ground contact parts 47 on the channel substrate 20 side are electrically connected to the ground interconnects on the COF 50.

A driver IC 51 is mounted on the COF 50. The COF 50 is connected to the controller 7 of the printer 1 (see FIG. 1). The driver IC 51 of each head unit 11 is electrically connected to the controller 7 via the COF 50 (see FIG. 7). The driver IC 51 of each head unit 11 generates and outputs a drive signal for driving a corresponding piezoelectric element 39 on the basis of a control signal received from the controller 7. The drive signal outputted from the driver IC 51 is inputted into the corresponding drive contact part 46 via the corresponding interconnect 55 of the COF 50 and is further supplied to the upper electrode 33 of the corresponding piezoelectric element 39 via the corresponding interconnect 35. Note that the lower electrode 31 is connected to a ground interconnect of the COF 50 via a ground contact part 47 so that the potential of the lower electrode 31 is constantly maintained at the ground potential.

When a drive signal is supplied to the upper electrode 33 of the piezoelectric element 39, the potential of the upper electrode 33 changes relative to the ground potential according to the signal waveform. Consequently, a potential difference is produced between the upper electrode 33 and lower electrode 31, applying a drive voltage to the active region 38. Further an electric field parallel to the thickness direction of the piezoelectric element 39 is applied to the active region 38, causing the active region 38 to expand in its thickness direction and shrink along the direction of its surface. When the diaphragm 30 deflects to form a convex shape on the pressure chamber 26 side in response to the deformation of the active region 38, a pressure wave is produced in the pressure chamber 26, causing an ink droplet to be ejected from the nozzle 24 that is in communication with the pressure chamber 26.

Cover Member

The cover member 23 is disposed on the top surface of the channel substrate 20 for covering the plurality of piezoelectric elements 39 in the piezoelectric actuator 22. As shown in FIG. 6, a pair of front and rear covering parts 54 is formed in the lower half portion of the cover member 23. The cover member 23 is bonded to the top surface of the diaphragm 30 formed over the channel substrate 20, with the two front and rear covering parts 54 covering the two front and rear piezoelectric layers 32.

An ink storage section 52 is formed in the upper half of the cover member 23 and is elongated in the nozzle alignment direction (the direction orthogonal to the paper surface of FIG. 6). The ink storage section 52 is in communication with the reservoir 12 of the inkjet head 4 (see FIG. 2). A plurality of ink supply channels 53 in communication with the ink storage section 52 is formed between the two covering parts 54 of the cover member 23. Each ink supply channel 53 also communicates with a corresponding pressure chamber 26 of the channel substrate 20 via a corresponding through-hole 30*a* formed in the diaphragm 30. With this configuration, ink in the ink storage section 52 is supplied to the plurality of pressure chambers 26 via the ink supply channels 53.

When drive voltages are repeatedly applied to the piezoelectric elements 39, the piezoelectric property of the piezoelectric elements 39 gradually deteriorates, leading to a gradual decline in the performance of the piezoelectric elements 39. However, as described above in the first embodiment, the nozzle layout area A of a head unit 11 in the front unit row 13*a* partially overlaps the nozzle layout area A of a head unit 11 in the rear unit row 13*b* with respect to the conveying direction. Printing within this overlapped region of the nozzle layout areas A can be performed using nozzles 24 in either the front or rear head units 11. Hence, if the piezoelectric elements 39 in the head unit 11 of one unit row 13 have deteriorated, printing can be performed using piezoelectric elements 39 in the head unit 11 of the other unit row 13 at positions corresponding to the deteriorated piezoelectric elements 39 (i.e., piezoelectric elements 39 that drive nozzles 24 in the same positions).

Switching Head Units within Overlapping Region

Figure 7:
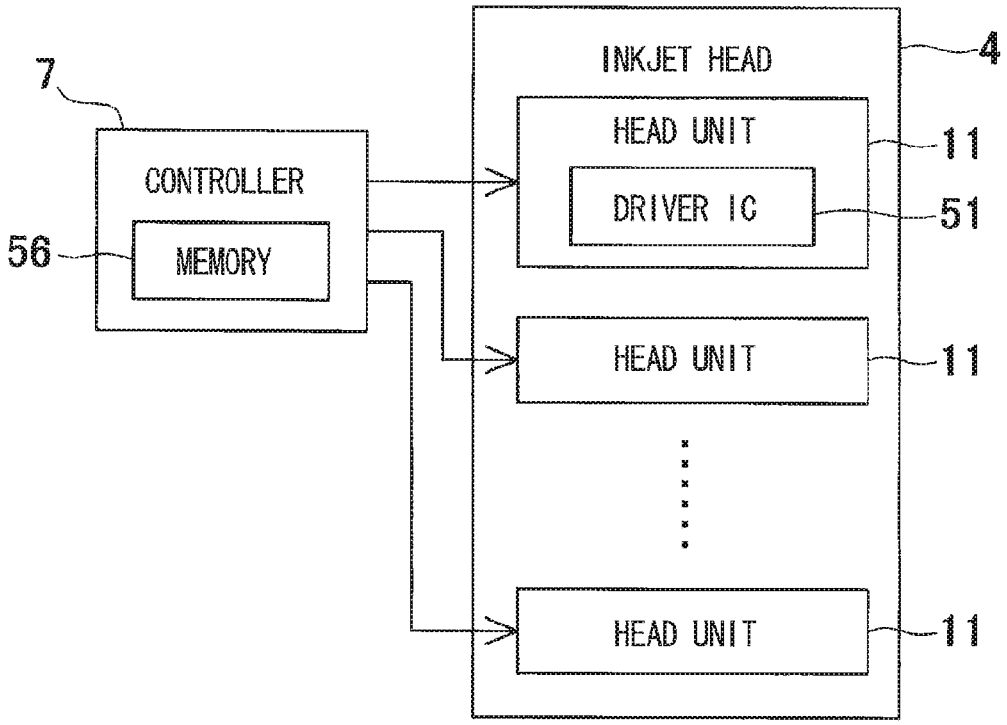
FIG. 7 is a block diagram showing a controller and an inkjet head of the printer according to the first embodiment.

Next, the method of switching head units 11 within a region that nozzle layout areas A of two head units 11 overlap will be described. As shown in FIG. 7, the plurality of head units 11 constituting an inkjet head 4 is connected to the controller 7. During a printing operation, the controller 7 transmits control signals to the driver ICs 51 of the head units 11 being used. The driver IC 51 of each head unit 11 generates drive signals based on the control signal received from the controller 7 and outputs the drive signals to the piezoelectric elements 39.

The controller 7 has a nonvolatile memory 56 that stores information related to the ink ejection frequency (frequency of use) of each inkjet head 4. Information related to ink ejection frequency of an inkjet head 4 may be data indicating the number of sheets 100 that have been printed, for example. Alternatively, the controller 7 may count the number of times each nozzle 24 of the inkjet head 4 has ejected ink (the number of times each piezoelectric element 39 has been driven) and may use this ejection count as the information related to ink ejection frequency. As another alternative, the controller 7 may measure the time that has elapsed since the printer 1 was first used until the present time and may use this elapsed time as the information related to ink ejection frequency.

The information described above related to the ink ejection frequency, such as the number of sheets that has been printed, is a parameter whose value grows larger for higher ink ejection frequencies. Hence, the controller 7 switches head units 11 by comparing the values of the parameters stored in the memory 56 to a prescribed threshold.

More specifically, the memory 56 stores two thresholds (a first threshold value V1 and a second threshold value V2) that are used for switching between two head units 11. The two thresholds have the relationship: first threshold value V1<second threshold value V2. If the number of sheets printed since the beginning of usage serves as the parameter for ink ejection frequency, the first threshold value V1 may be set to 20,000 sheets and the second threshold value V2 to 40,000 sheets, for example.

When the value of the parameter related to ink ejection frequency is less than the first threshold value V1, i.e., when the number of times an inkjet head 4 has been used is still at a low stage, the controller 7 uses only head units 11 in one of the unit row 13*a* and 13*b*. For example, the controller 7 determines the nozzles 24 of the unit row 13*a* disposed in the overlapping region as nozzles to be used for ejecting ink droplet.

When the value of the parameter is greater than or equal to the first threshold value V1 but less than the second threshold value V2, i.e., when the inkjet head 4 has been used a moderately large number of times, the controller 7 uses head units 11 in both unit rows 13*a* and 13*b*. In other words, the controller 7 uses some of the nozzles 24 in one head unit 11 and some of the nozzles 24 in the other head unit 11 within the range of overlapping nozzle layout areas A for the two head units 11. Note that the nozzles used in one head unit 11 and the nozzles used in the other head unit 11 must not be in overlapping positions in the conveying direction.

When the value of the parameter exceeds the second threshold value V2, i.e., when the inkjet head 4 has been used a considerably large number of times, the controller 7 uses only the head unit 11 in another unit row that is other than the one of the unit rows 13*a* and 13*b* used when the value of the parameter is less than the first threshold value V1. For example, the controller 7 determines the nozzles 24 of the unit row 13*b* disposed in the overlapping region as nozzles to be used for ejecting ink droplet.

Relationship between Usage Frequency of Head Units and Overlap Length of Head Units Deterioration of piezoelectric elements 39 in a head unit 11 progresses more rapidly when voltages are applied to the piezoelectric elements 39 with greater frequency. During typical printing on a printer, text, images, and the like are most frequently printed in the widthwise center region of sheets 100, with little printing performed in the edge regions. Thus, in a single inkjet head 4, a difference in usage frequency occurs between head units 11 that eject ink toward the widthwise center region of the sheet 100 (hereinafter called "center head units 11") and head units 11 that eject ink toward the edge regions (hereinafter called "edge head units 11"). Consequently, the piezoelectric elements 39 in center head units 11 are driven with greater frequency than piezoelectric elements 39 in edge head units 11, leading to more rapid deterioration in the piezoelectric elements 39 of center head units 11. This can lead to a condition in which piezoelectric elements in center head units 11 have degraded to the point of being unusable while the piezoelectric elements of edge head units 11 still have sufficient performance.

For this reason, the inkjet head 4 according to the first embodiment is configured such that head units 11 in the two unit rows 13 overlap by a greater amount in the center region relative to the nozzle alignment direction than in the edge regions, as illustrated in FIG. 3. Since the head units 11 have a greater overlap length in the center region of the inkjet head 4, there is a broader range in which it is possible to switch to the head unit 11 of a second unit row 13 when the piezoelectric elements 39 in the head unit 11 of the first unit row 13 have degraded. Thus, when piezoelectric elements 39 of a head unit 11 positioned in the center region have degraded, the inkjet head 4 can still be used thereafter by switching most piezoelectric elements 39 to the other head unit 11, thereby increasing the product life.

Conversely, the edge regions of the inkjet head 4 are not used as frequently as the center region. Therefore, if the overlap length of head units 11 were to be increased in such regions having low frequency of use, the number of head units 11 required to configure a single inkjet head 4 would be increased. Accordingly, the overlap length of head units 11 in the edge regions of the inkjet heads 4 can be set smaller than that in the center regions. In the first embodiment, head units 11 in the two unit rows 13 do not overlap at all in the edge regions of the inkjet head 4 (the first portion B1 and second portion B2). That is, the overlap length of head units 11 in each of the first portion B1 and the second portion B2 is zero. This arrangement minimizes the number of required head units 11.

While the partial overlap of nozzle layout areas A in the head units 11 was described earlier, the usage frequency of each portion of the inkjet head 4 is generally highest in the center region with respect to the width direction of the sheets 100, lowest in the edge regions, and gradually decreasing in frequency from the center region toward the edge regions. On the basis of this information, the overlap length of head units 11 in the inkjet head 4 of the first embodiment decreases toward the edges in the nozzle alignment direction. Specifically, the overlap length (La) of head units 11 in the fifth portion B5 positioned in the center with respect to the nozzle alignment direction is greatest and the overlap length (Lb) of head units 11 in the third portion B3 and fourth portion B4 on both sides of the fifth portion B5 is less. Further, head units 11 do not overlap at all in the first portion B1 and second portion B2 in the edge regions of the inkjet head 4.

The sheet 100 serves as an example of a recording medium. Each of the conveying rollers 5 and 6 servers as an example of a conveying unit. The nonvolatile memory 56 serves as an example of a storage device.

Next, variations of the first embodiment described above including various modifications will be described, wherein like parts and components are designated with the same reference numerals to avoid duplicating description.

Figure 8:
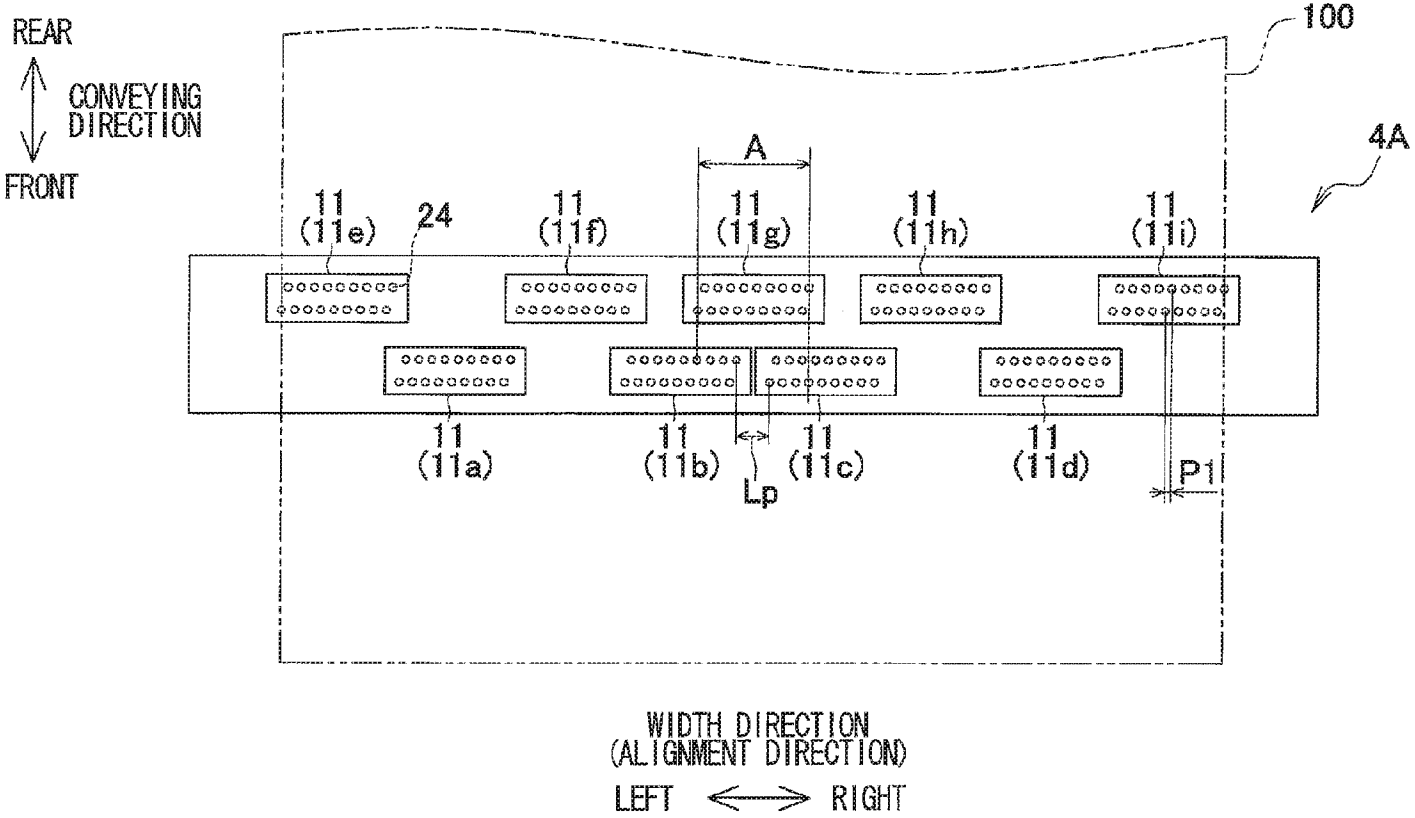
FIG. 8 is a plan view of an inkjet head of a printer according to a modification of the first embodiment.

(1) The overlap length of head units 11 in the two unit rows 13 should be as great as possible in the center region of the inkjet head 4, which has the highest frequency of use. To this end, two head units 11 in the center region of one unit row 13 that are juxtaposed in the nozzle alignment direction are preferably arranged adjacent to each other to achieve the smallest possible nozzle-row gap Lp in the nozzle alignment direction between nozzles in the two head units 11, as illustrated in an inkjet head 4A of FIG. 8.

As can be seen in FIG. 4, each head unit 11 has areas on both sides of the nozzle rows in the nozzle alignment direction in which no nozzles 24 are formed. Consequently, the nozzle-row gap Lp between two head units 11 in one unit row 13 is inevitably larger than the nozzle pitch P1 in each head unit 11. Further, since the positions of nozzles 24 in corresponding front and rear head units 11 are aligned within the overlapping region, as described above in the first embodiment, the nozzle-row gap Lp between two head units 11 that neighbor each other in the nozzle alignment direction must meet the condition of being an integer multiple of the nozzle pitch P1 in each head unit 11.

In other words, two neighboring head units 11 in the nozzle alignment direction (11*b*, 11 *c*) are preferably arranged as close to each other as possible while still satisfying the condition that the nozzle-row gap Lp between the two nozzles is an integer multiple of the nozzle pitch P1 in each head unit 11. With this arrangement, the nozzle layout areas A of the two front head units 11*b* and 11*c* can overlap nearly the entire nozzle layout area A of the rear head unit 11*g*.

(2) In FIG. 3 of the first embodiment described above, the overlap length of head units 11 in the two unit rows 13 is equal on left and right sides of the center region constituting the inkjet head 4. However, the overlap length of head units 11 on the left and right ends may differ, as in an inkjet head 4B shown in FIG. 9.

This arrangement is effective when the usage frequency of head units 11 differs not only between the center region and the end regions, but also between the left side and the right side. In the inkjet head 4B of FIG. 9, the overlap length of head units 11 is increased on the side relative to the nozzle alignment direction expected to have a higher frequency of use and decreased on the side expected to have a lower frequency of use.

This is particularly effective when printing text horizontally on the sheet 100 from left to right, as such text is generally left-justified. That is, from the perspective of a user facing the front of the printer (the downstream side in the conveying direction), a greater amount of printing is performed on the left-side portion of the sheet 100 being conveyed toward the user than on the right-side portion. Therefore, the usage frequency of a left head unit 11 will be higher than that of a right head unit 11. Accordingly, when viewing the printer 1 from the downstream side in the conveying direction, the overlap length of head units 11 in the two unit rows 13 is made larger on the left end of the inkjet head 4B than the right end.

Figure 9:
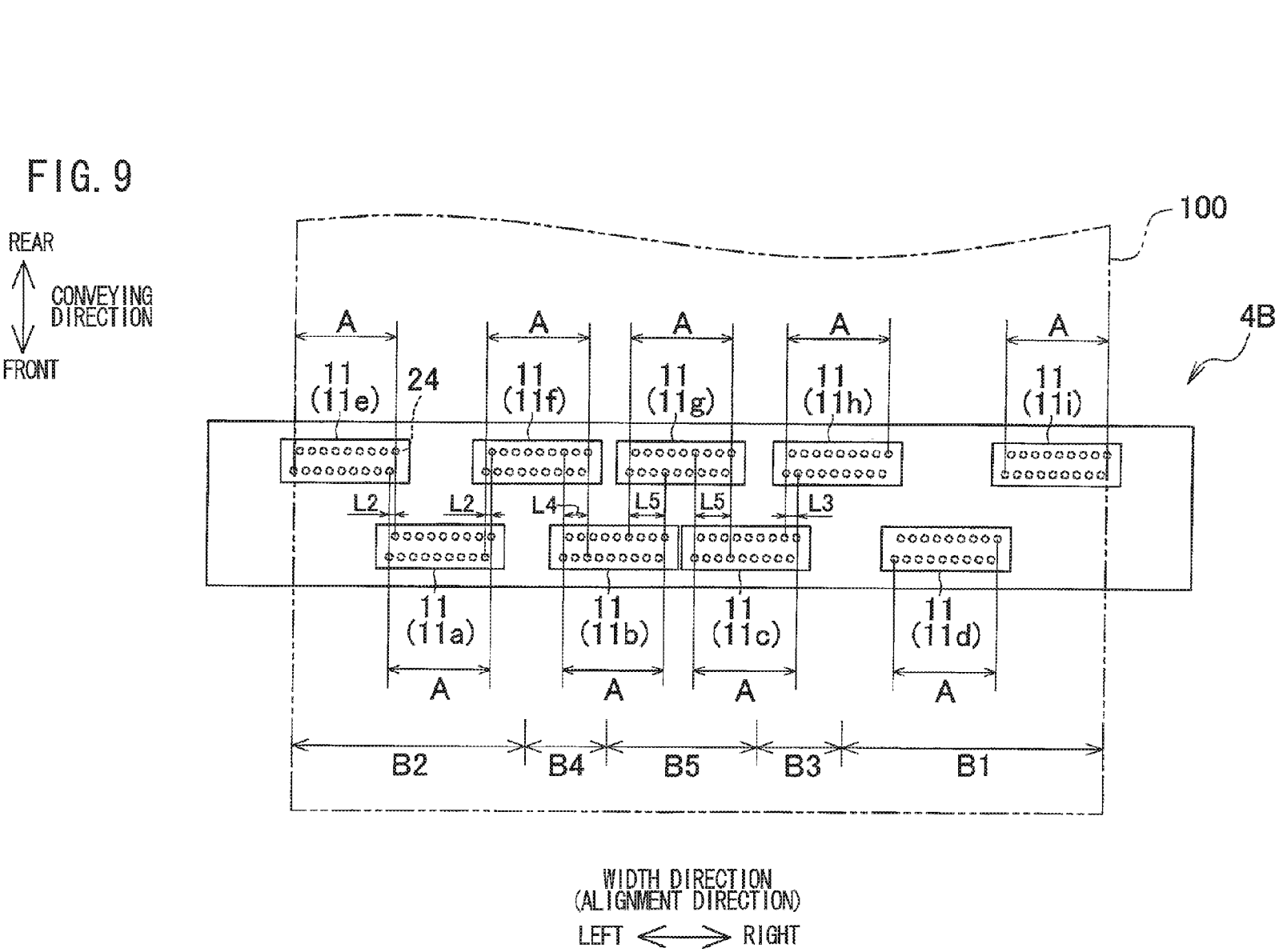
FIG. 9 is a plan view of an inkjet head of a printer according to another modification of the first embodiment.

More specifically, the overlap length of head units 11 in the inkjet head 4B of FIG. 9 is set in order from largest to smallest beginning from the fifth portion B5 in the center region (overlap length L5), the fourth portion B4 adjacent to the left side of the fifth portion B5 (overlap length L4), the third portion B3 adjacent to the right side of the fifth portion B5 (overlap length L3), the second portion B2 on the left end (overlap length L2), and the first portion B1 on the right end (no overlap between head units 11).

(3) When the printer is capable of conveying two types of recording sheets having different widths, the usage frequency of a head unit 11 differs depending on whether the head unit 11 falls within the conveyed region of both types of recording sheets or only falls within the conveying region of one type of recording sheet.

Figure 10:
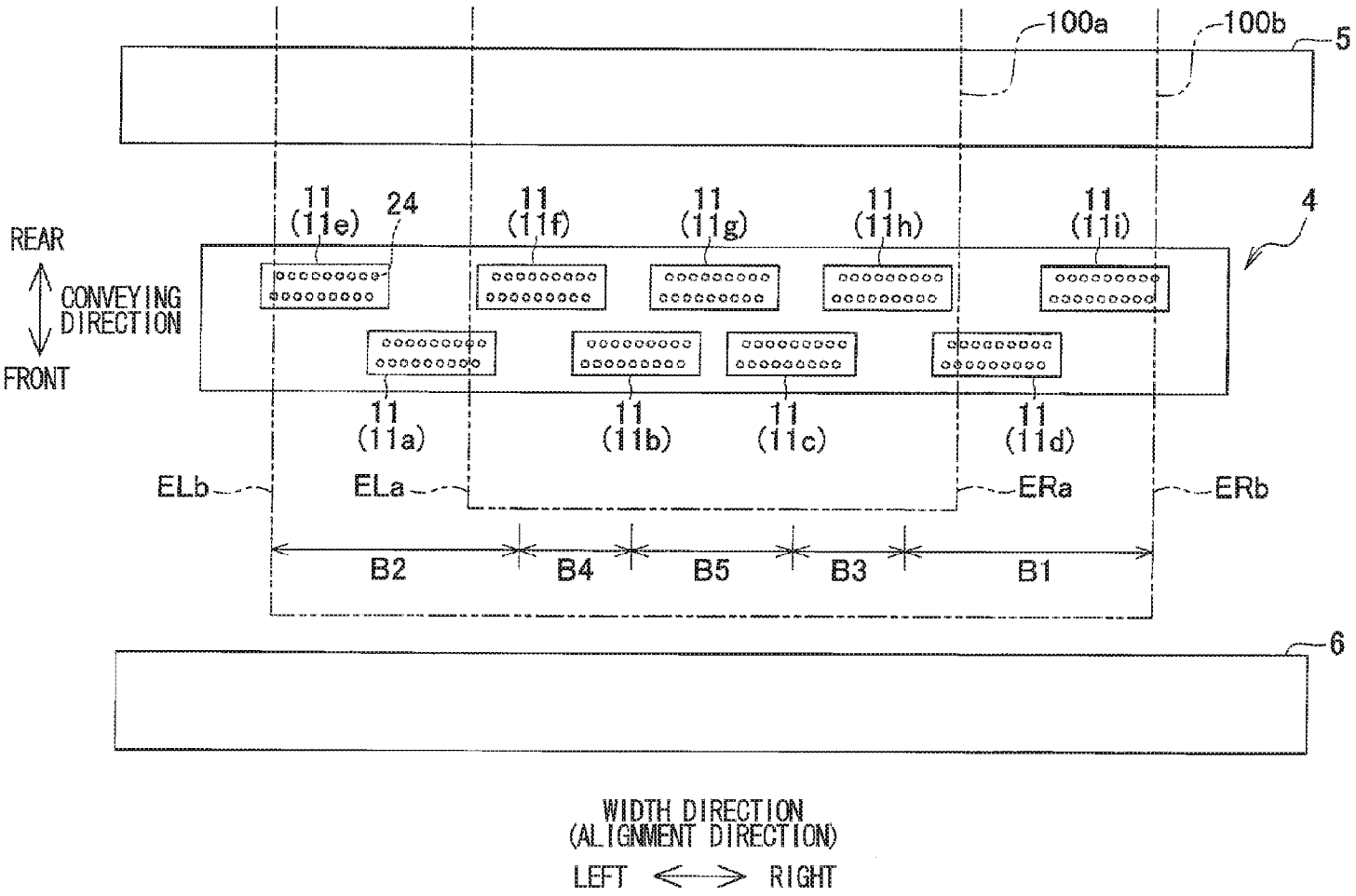
FIG. 10 is a plan view of an inkjet head of a printer according to still another modification of the first embodiment.

In the example of FIG. 10, the conveying rollers 5 and 6 are capable of conveying a first recording sheet 100*a*, and a second recording sheet 100*b* having a larger width than the first recording sheet 100*a* in the width direction (direction of nozzle alignment). First recording sheets 100*a* and second recording sheets 100*b* are accommodated in separate paper trays (not shown). Pickup rollers (not shown) selectively pick up and convey either the first recording sheet 100*a* or second recording sheet 100*b* from its respective paper tray to the conveying rollers 5 and 6. The conveying rollers 5 and 6 convey the first recording sheet 100*a* or second recording sheet 100*b* fed from the respective paper tray in the conveying direction so that the sheet passes below the inkjet head 4. Note that only a single inkjet head 4 is provided between the conveying rollers 5 and 6 in FIG. 10, but four of the inkjet heads 4 may be juxtaposed in the conveying direction, as shown in FIG. 1 of the first embodiment described above.

With respect to the width direction of the sheets, the edges of the conveying region through which the first recording sheet 100*a* is conveyed (positions of the widthwise edges of the first recording sheet 100*a*) fall within the conveying region of the second recording sheet 100*b*. With this arrangement, head units 11 in the center of the nozzle alignment direction that are positioned within the conveying region of the first recording sheet 100*a* are used for printing both types of recording sheets 100*a* and 100*b*.

However, since head units 11 positioned outside the conveying region of the first recording sheet 100*a* are used only for printing the second recording sheets 100*b*, it is acceptable to set the overlap length of head units 11 outside this conveying region smaller. Conversely, if the overlap length of head units 11 in this region were to be increased, the number of head units 11 constituting a single inkjet head 4 would be unnecessarily large.

Therefore, the end portions of the inkjet head 4 in FIG. 10 with respect to the nozzle alignment direction in which the overlap length of head units 11 is set smaller fall in areas between the positions through which widthwise edges of the first recording sheet 100*a* pass and the positions through which widthwise edges of the second recording sheet 100*b* pass (areas through which only the second recording sheets 100*b* pass). More specifically, when the inkjet head 4 is divided into five sections, including the first through fifth portions B1-B5 as in the first embodiment described above, the first portion B1 on the right end of the inkjet head 4 includes the area between a right edge ERa of the first recording sheet 100*a* and a right edge ERb of the second recording sheet 100*b*. Similarly, the second portion B2 on the left end of the inkjet head 4 includes the area between a left edge ELa of the first recording sheet 100*a* and a left edge ELb of the second recording sheet 100*b*. The first recording sheet 100*a* serves as an example of a first recording medium, while the second recording sheet 100*b* serves as an example of a second recording medium. The area between a position corresponding to the right edge ERa of the first recording sheet 100*a* and a position corresponding to the right edge ERb of the second recording sheet 100*b* serves as an example of an upstream end portion. The area between a position corresponding to the left edge ELa of the first recording sheet 100*a* and a position corresponding to the left edge ELb of the second recording sheet 100*b* serves as an example of a downstream end portion.

(4) When the printer has a configuration for detecting ejection failure in the nozzles 24 of each head unit 11, it is preferable to store information in memory of the controller 7 (see FIG. 1) or the like indicating which nozzles 24 are defective. In this case, when the defective nozzles are present in an overlapping region of nozzle layout areas A of two head units 11, the nozzles to be used in the overlapping region of two head units 11 can be switched to exclude the defective nozzles. In other words, a functioning nozzle at the same position as a defective nozzle along the width dimension of the recording paper may be used continuously in place of the defective nozzle regardless of its ejection frequency.

(5) In the first embodiment described above, the head units 11 for a single inkjet head 4 are arranged in two unit rows, but the head units 11 may be arranged in three or more unit rows instead.

(6) The driving elements that function to eject ink from nozzles are not limited to the piezoelectric elements described in the first embodiment. For example, the driving elements may be configured of heating elements that heat ink to cause film boiling.

Second Embodiment

Figure 11:
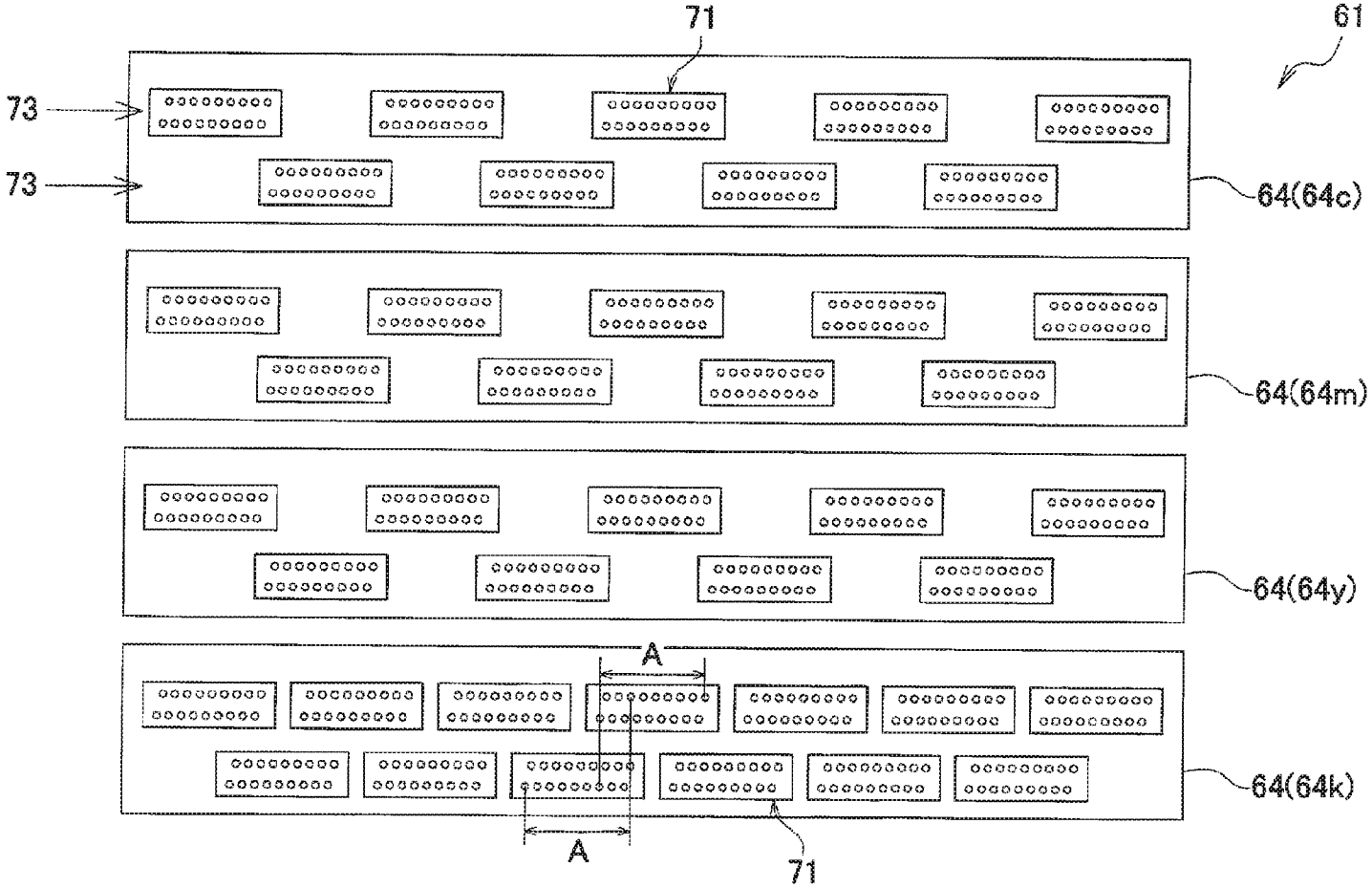
FIG. 11 is a plan view of an inkjet head of a printer according to a second embodiment.

Next, a printer 61 according to a second embodiment will be described. The printer 61 according to the second embodiment has the same overall structure as the printer 1 in the first embodiment described above. As shown in FIG. 11, the printer 61 has four inkjet heads 64 juxtaposed in the conveying direction of the sheet 100. The four inkjet heads 64 (64*c*, 64*m*, 64*y*, and 64*k*) are configured to eject ink in the four colors cyan, magenta, yellow, and black, respectively. Each inkjet head 64 includes a plurality of head units 71 aligned in a direction of nozzle alignment corresponding to the width dimension of the sheet 100.

As in the first embodiment described above, the head units 71 of each inkjet head 64 are arranged in two unit rows 73, each having a plurality of head units 71 aligned in the nozzle alignment direction. The positions of the head units 71 relative to the nozzle alignment direction are offset between the two unit rows 73. The head units 71 have the same structure as the head units 11 described in the first embodiment and, therefore, a description of this structure will not be repeated.

In the printer 61 according to the second embodiment, the overlap length of nozzle layout areas A in the head units 71 differs between some inkjet heads 64 (64*k*) and the remaining inkjet heads 64 (64*c*, 64*m*, and 64*y*). This configuration is effective when the frequency of use differs among inkjet heads that eject different types of ink.

Particularly, in color inkjet printers that use a plurality of ink colors, black ink used for printing text has a considerably higher frequency of use than color ink used for printing images and the like. Therefore, the overlap length of head units 71 in the inkjet head 64*k* that ejects black ink is greater than the three inkjet heads 64*c*, 64*m*, and 64*y* that eject colored ink. Note that the number of head units 71 configuring the inkjet head 64*k* is greater than the number used for configuring each of the inkjet heads 64*c*, 64*m*, and 64*y* in order to increase the overlap length of head units 71.

With the configuration of the second embodiment, when piezoelectric elements in the head units 71 of one unit row 73 become degraded in the black inkjet head 64*k* having a high frequency of use, it is possible to switch to piezoelectric elements in the head units 71 of the other unit row 73 over a wide range, since the overlap length of head units 71 between the two unit rows 73 is large. Thus, even when piezoelectric elements become degraded in the head units 71 of one unit row 73, it is possible to switch to the head units 71 of the other unit row 73 and to use these head units 71 thereafter to extend the life of the product.

The black ink serves as an example of first ink. Each of cyan, magenta, yellow inks serves as an example of second ink. The inkjet head 64K serves as an example of a first inkjet head. Each of the inkjet heads 64*c*, 64*m*, and 64*y* serves as an example of a second inkjet head.

Note that the inkjet head 64 configured with a greater overlap length of head units 71 is not restricted to the inkjet head 64*k* for black ink. For example, in a printer that prints using special ink, such as white ink, the inkjet head that ejects the special ink may have the highest frequency of use. In this case, the head units 71 in the inkjet head 64 that ejects the special ink may be configured to have a greater overlap length.

What is claimed is:

1. A printer comprising:

a conveying unit configured to convey a recording medium in a conveying direction; and an inkjet head configured to eject an ink droplet on the recording medium, the inkjet head including a plurality of head units, each of the plurality of head units having a nozzle layout area in which a plurality of nozzles is arranged in an alignment direction crossing the conveying direction, the plurality of head units being arranged in at least two rows each extending in the alignment direction, the at least two rows including a first row and a second row that are arranged in the conveying direction, the inkjet head having end portions and a center portion between the end portions in the alignment direction, each set of two head units of the plurality of head units including one head unit in the first row and another head unit in the second row and defining an overlap length, the overlap length being a length in the alignment direction of an overlap region in which a part of the nozzle layout area of the one head unit and a part of the nozzle layout area of the another head unit overlap in the conveying direction, the one head unit being shifted from the another head unit in the alignment direction, the overlap length defined by a set of two head units in the center portion being larger than the overlap length defined by a set of two head units in each of the end portions.

2. The printer according to claim 1, further comprising:

a storage device storing information related to frequency of ink ejection of the inkjet head; and a controller configured to control each of the plurality of head units and to switch a nozzle to be used for ejecting an ink droplet in the overlap region between a first nozzle and a second nozzle on a basis of the information stored in the storage device, the first nozzle being a nozzle that is included in the part of the nozzle layout area of the one head unit, the second nozzle being a nozzle that is included in the part of the nozzle layout area of the another head unit, the first nozzle and the second nozzle overlapping in the conveying direction.

3. The printer according to claim 2, wherein the information related to frequency of ink ejection of the inkjet head indicates a number of sheets of recording media that have been printed by the inkjet head.

4. The printer according to claim 2, wherein the information related to frequency of ink ejection of the inkjet head is a parameter whose value grows larger for higher frequencies of ink ejection;

wherein the controller is further configured to determine, as a head unit including the nozzle to be used in the overlap region, at least one of the one head unit and the another head unit such that:

one of the one head unit and the another head unit is determined to be used when the parameter is smaller than a first threshold value;

both of the one head unit and the another head unit are determined to be used when the parameter is greater than or equal to the first threshold value and smaller than a second threshold value, the second threshold value being greater than the first threshold value; and another of the one head unit and the another head unit is determined to be used when the parameter is greater than or equal to the second threshold value.

5. The printer according to claim 1, wherein the overlap length decreases from the center portion toward the end portions in the alignment direction.

6. The printer according to claim 1, wherein the overlap length defined by a set of two head units in one of the end portions is larger than the overlap length defined by a set of two head units in another of the end portions.

7. The printer according to claim 6, wherein the one of the end portions is a left end portion of the inkjet head viewed from a downstream side in the conveying direction, and wherein the another of the end portions is a right end portion of the inkjet head viewed from the downstream side in the conveying direction.

8. The printer according to claim 7, wherein the inkjet head includes:

a first portion being the right end portion;

a second portion being the left end portion;

a third portion adjacent to a left side of the first portion;

a fourth portion adjacent to a right side of the second portion; and a fifth portion being the center portion, wherein the overlap lengths are set in order from largest to smallest beginning from the fifth portion, the fourth portion, the third portion, the second portion, and the first portion.

9. The printer according to claim 1, wherein the conveying unit is configured to convey a first recording medium and a second recording medium, the first recording medium having a first edge and a second edge disposed downstream from the first edge in the alignment direction, the second recording medium having a third edge and a fourth edge disposed downstream from the third edge in the alignment direction;

wherein the end portions include: an upstream end portion between a position corresponding to the first edge and a position corresponding to the third edge in the alignment direction; and a downstream end portion between a position corresponding to the second edge and a position corresponding to the fourth edge in the alignment direction.

10. The printer according to claim 1, wherein the overlap length in each of the end portions is zero.

11. The printer according to claim 1, wherein a gap between two adjacent nozzles is an integer multiple of a nozzle pitch of the plurality of nozzles in each of the plurality of head units, the two adjacent nozzles including:

a most-upstream nozzle of the plurality of nozzles included in one of two adjacent head units, the two adjacent head units being arranged in one of the first row and the second row and adjacent to each other; and a most-downstream nozzle of the plurality of nozzles included in another of the two adjacent head units and disposed upstream from the one of the two adjacent head units in the alignment direction.

12. The printer according to claim 1, wherein each of the plurality of head units further comprises a piezoelectric element including:

a first electrode;

a second electrode; and a piezoelectric film interposed between the first electrode and the second electrode.

13. A printer comprising:

a conveying unit configured to convey a recording medium in a conveying direction; and a first inkjet head configured to eject first ink on the recording medium;

a second inkjet head configured to eject second ink on the recording medium, the first inkjet head and the second inkjet head being arranged in the conveying direction, each of the first inkjet head and the second inkjet head having a plurality of head units arranged in an alignment direction crossing the conveying direction, each of the plurality of head units having a nozzle layout area in which a plurality of nozzles is arranged in the alignment direction, the plurality of head units being arranged in at least two rows each extending in the alignment direction, the at least two rows including a first row and a second row arranged in the conveying direction, each set of two head units of the plurality of head units including one head unit in the first row and another head unit in the second row and defining an overlap length, the overlap length being a length in the alignment direction of an overlap region in which a part of the nozzle layout area of the one head unit and a part of the nozzle layout area of the another head unit overlap in the conveying direction, the one head unit being shifted from the another head unit in the alignment direction, the overlap length defined by a set of two head units disposed in the first inkjet head being larger than the overlap length defined by a set of two head units disposed in the second inkjet head.

14. The printer according to claim 13, wherein the first ink is black ink.

* * * * *